United States Patent [19]

Clark et al.

[11] 4,336,312

[45] Jun. 22, 1982

[54] WELDABLE NICKEL BASE CAST ALLOY FOR HIGH TEMPERATURE APPLICATIONS AND METHOD

[75] Inventors: Jeffrey J. Clark; Harry R. Fisk; Larry A. Wallace, all of Tempe, Ariz.

[73] Assignee: The Garrett Corporation, Los Angeles, Calif.

[21] Appl. No.: 116,691

[22] Filed: Jan. 30, 1980

[51] Int. Cl.[3] ..... B32B 15/00

[52] U.S. Cl. ..... 428/680; 148/3; 148/127; 148/162; 148/410

[58] Field of Search ..... 75/171, 170; 428/680; 148/32, 32.5, 3, 162, 127

[56] References Cited

U.S. PATENT DOCUMENTS 2,570,193 10/1951 Bieber et al. ..... 75/171

*Primary Examiner*—R. Dean

*Attorney, Agent, or Firm*—Donald W. Canady; James W. McFarland; Albert J. Miller

[57] ABSTRACT

The composition of a nickel base cast alloy for high temperature structural parts is modified by controlled reduction of the aluminum content and increasing the carbon content to significantly reduce the occurrence of base metal cracking in the heat-affected zone during fusion welding operations. The modified nickel base casting alloy is subjected to a pre-weld thermal conditioning in order to prevent strain age cracking of the weldments during post-weld thermal cycling operations.

11 Claims, No Drawings

WELDABLE NICKEL BASE CAST ALLOY FOR HIGH TEMPERATURE APPLICATIONS AND METHOD

BACKGROUND OF THE INVENTION

Nickle base cast alloys are extensively used for turbine component design requiring corrosion resistance and high temperature strengths for use at temperatures as high as about 1800° F. Three such closely related alloys manufactured by International Nickel Company, are designated inconel 713C, Inconel 713LC and IN 100, which have the following nominal chemical composition (weight percent):

| Element | 713C | 713LC | IN 100 |
|---|---|---|---|
| Chromium | 12.5 | 12.0 | 10.0 |
| Molybdenum | 4.2 | 4.5 | 3.0 |
| Carbon | 0.12 | 0.05 | 0.18 |
| Aluminum | 6.1 | 5.9 | 5.5 |
| Titanium | 0.8 | 0.6 | 4.7 |
| Columbium plus Tantalum | 2.0 | 2.0 | — |
| Zirconium | 0.10 | 0.10 | 0.06 |
| Cobalt | — | — | 15.0 |
| Boron | 0.012 | 0.010 | 0.014 |
| Nickel | Balance | Balance | Balance |

The poor weldability of such nickel base alloys results in frequent problems of base metal cracking during the welding process and subsequent high temperature brazing or heat treat cycles. It is believed that during welding, a low melting point constituent is formed at the grain boundaries which causes cracking in the base metal heat-affected zone because the heat generated during welding causes melting of this eutectic phase (constituent) which subsequently cracks at the grain boundaries during weld solidification. This chronic problem causes excessive and costly rework of welded components and prevents optimum design latitude for components requiring joining during fabrication.

DISCUSSION OF THE PRIOR ART

Previous studies have shown that welding procedures, techniques, tooling modifications, and filler wire selections do not eliminate the base metal cracking experience during the welding of Nickel base casting alloys. Electron beam welding is sometimes utilized for welding such alloys to minimize crack formation by producing welds with minimum heat input. Notwithstanding such precautions, sufficient weld cracking still occurs to add significant cost to structural units containing such Nickel base castings, due to expensive reworking and scrapping.

An attempt to alleviate the weld cracking problem in nickel base alloys was reported in the International Aerospace abstracts, No. 982, received August 30, 1970 in an article entitled, "Weldability of Nickel Base Heat Resisting Superalloy—Main Cause Of Weld Cracking And Heat Affected Zone of Inconel 713", by Hiroshi Ikawa, et al from Osaka University, Osaka, Japan, Department of Welding Engineering. The Ikawa et al work noted the presence of a white constituent at the grain boundaries in Inconel 713 type alloys which were weld crack sensitive and conversely the absence of such constituents in the case of crack-free welding of nickel base alloys. They noted that a base metal chemistry having an aluminum content below 4% or a carbon content on the order of 0.25% resulted in alloys whose microstructures were devoid of the white constituent. The Ikawa et al article, however, was not concerned with the production of a weldable alloy with mechanical properties suitable for structural applications. In fact, the suggested alloys of Ikawa et al are believed to be prone to strain age cracking upon thermal cycling following welding.

SUMMARY OF THE INVENTION

Our present invention involves the improvement of the welding characteristics of a nickel base cast alloy used for static components requiring corrosion resistance and high temperature strength at temperatures as high as 1800° F. In accordance with our invention, the conventional nickel base castable superalloys are modified by controlled reduction of the aluminum content and an increase in carbon content to significantly reduce the hot cracking which normally occurs during welding in the base metal heat-affected zone. This cracking is believed to be caused by the formation of a low melting point constituent at the grain boundaries during welding, which melts due to the welding heat and cracks upon weld solidification. Accordingly, our present invention provides a modified alloy with a higher incipient melting point of the base metal alloy.

In accordance with another facet of our present invention, the as-cast modified nickel base alloy component is subjected to a pre-weld thermal conditioning cycle which is believed to result in a precipitate that retains adequate ductility within the grains and thereby eliminates strain age cracking in the weld zone when the material is subjected to post-weld thermal cycling as in high temperature brazing or heat treatment.

The nickel base cast alloy of our present invention is a modification of the type of alloys which are commercially available, for example, from International Nickel Company under the designations given above with their respective alloy chemistries. The above referenced prior art alloy chemistries are modified in accordance with our present invention, by increasing the carbon content range to about 0.16 to 0.26% and reducing the aluminum content to the range of about 4.5 to 5.5%. It is also believed that the lowering of the zirconium range from 0.05 to 0.15% to 0.05 to 0.10% is beneficial to our present invention, however, not critical. The pre-weld thermal conditioning necessary to prevent occurrence of strain age cracking upon subsequent thermal cycling of our modified alloy, in accordance with our present invention, comprises heating the material preferably in a vacuum or a controlled atmosphere, to about 1950° F. (±25° F.) and holding the material at this temperature for at least about 45 minutes, followed by furnace cooling to about 1850° F. (±25° F.) and holding the material at this reduced temperature for at least about 2 hours, followed by cooling to ambient temperature at a rate to similate an air cool, e.g. furnace cooling. The above pre-weld thermal conditioning may require longer holding times for temperature equalization for treatment of structural components of cross-section or thickness substantially greater than the components prepared for our present study, i.e. about 0.25 inch thickness.

The alloys modified and heat treated in accordance with our present invention are found to have substantially the same mechanical properties and thermal stability as the prior art nickel base alloys identified as Inconel 713C and 713LC, the slightly lower ductility being still acceptable for the particular structural components investigated.

DESCRIPTION OF THE PREFERRED EMBODIMENTS

In accordance with our present invention, a conventional nickel base castable superalloy is modified by the controlled reduction of the aluminum content and increase of the carbon content to improve the heat affected zone cracking resistance during fusion welding operations, and the prevention of strain age cracking of weldments of such modified alloys during post-weld thermal cycling operations such as brazing and heat treatment operations, by heating the material, prior to welding, to about 1950° F. (±25° F.) and holding at such temperature for at least about 45 minutes and then cooling to about 1850° F. and holding at this temperature for at least about 2 hours, followed by furnace cooling to ambient temperature.

It is believed that the compositional modification of the nickel base alloy in accordance with our present invention is effective in eliminating the low melting eutectic gamma prime phase and providing a higher incipient melting point of the base metal alloy. The decrease of aluminum content coupled with an increase in carbon in our present alloy prevents the formation of the abovementioned low melting eutectic phase which is normally inherent in most high temperature cast nickel alloys. The gamma prime eutectic phase is an intermetallic compound of nickel and aluminum into which titanium may be substituted. Hence, during the welding of the alloy of our present invention, the weld stresses are adequately accommodated within the more ductile intergranular area, thus preventing cracking at the less ductile grain boundaries. The Aluminum content should not be reduced below about 4.5% since further reduction appears to reduce the strength of our modified nickel base alloy, more than is desirable. Hence, our acceptable aluminum range is 4.5 to 5.5% with the preferred range being about 5.0 to 5.5%. Increasing the carbon content in accordance with our invention above about 0.26, while acceptable from a weld cracking standpoint, tends to reduce the tensile ductility below desirable limits through excessive carbide formation, and hence the acceptable carbon range, in accordance with our present invention, is about 0.16 to 0.26 with the preferred range being about 0.20 to 0.26% C.

The strain age cracking problem is believed to be caused by the rapid precipitation, contraction, and strengthening within the grains during post-weld thermal-cycle which occurs at a faster rate than the weld stresses are being relieved. The result is a transmittal of stresses to the less ductile grain boundaries causing fracture at these high stress points. This phenomena, known as strain age cracking, is eliminated in accordance with our present invention by a pre-weld thermal conditioning cycle which is done to slightly overage the material with a resultant precipitation that retains adequate ductility within the grains.

The pre-weld thermal conditioning in accordance with our present invention is not generally performed in respect to the cast nickel base superalloys since such alloys are not considered to be heat-treatable as are wrought nickel base superalloys. In accordance with our invention, the thermal conditioning should be performed prior to welding and it may be performed either at the foundry immediately following casting, before machining, or the conditioning may be performed after machining (but before welding). The thermal conditioning hold times are approximate minimum times, since thicker material may require additional time to reach thermal equilibrium. Hence, the conditioning sequence requires heating to about 1950° F. (±25° F.) for a minimum of about 45 minutes, followed by cooling to 1850° F. (±25° F.) and holding for a minimum of about two hours, followed by slow cooling.

Our invention comprising controlled chemical modification of cast nickel base superalloys coupled with pre-weld thermal conditioning, is believed applicable primarily to cast nickel base alloys for elevated temperature service, specifically cast gamma prime phase strengthened nickel base superalloys. Such commercially available alloys as Inconel 713C, Inconel 713LC and IN 100 are among the alloys which may be improved by our present invention.

EXAMPLES

Five alloys which are a modification of a conventional Nickel base cast superalloy (Inconel 713LC), in accordance with our present invention, were procured and three pours of varying carbon and nickel amounts were made of each of these alloys, for a total of 15 pours. The analysis of each of these alloys together with the standard chemical specification for Inconel 713LC is shown in Table I.

TABLE I

| | | Composition Code | | | | | | | | | | | | | | |
|---|---|---|---|---|---|---|---|---|---|---|---|---|---|---|---|---|
| Element | 713LC | A-1 | A-2 | A-3 | B-1 | B-2 | B-3 | C-1 | C-2 | C-3 | D-1 | D-2 | D-3 | E-1 | E-2 | E-3 |
| C | 0.05–0.07 | .20 | .23 | .22 | .26 | .26 | .26 | .30 | .26 | .31 | .26 | .26 | .26 | .21 | .22 | .22 |
| Cr | 11–13 | 12.1 | — | — | 12.1 | — | — | 12.1 | — | — | 11.1 | — | — | 10.3 | — | — |
| Mo | 3.8–5.2 | 3.68 | — | — | 3.67 | — | — | 3.67 | — | — | 3.29 | — | — | 2.94 | — | — |
| Cb + Ta | 1.8–2.8 | 1.65 | — | — | 1.67 | — | — | 1.65 | — | — | 1.47 | — | — | 1.34 | — | — |
| Ti | 0.5–1.0 | .63 | — | — | .62 | — | — | .62 | — | — | .58 | — | — | .54 | — | — |
| Al | 5.5–6.5 | 5.36 | 5.37 | 5.10 | 5.20 | 5.06 | 5.21 | 5.24 | 5.09 | 5.16 | 4.66 | 4.48 | 4.66 | 4.13 | 4.14 | 4.18 |
| Zr | .05–.15 | .09 | — | — | .09 | — | — | .08 | — | — | .08 | — | — | .07 | — | — |
| Ni | Bal. | Bal. | Bal. | Bal. | Bal. | Bal. | Bal. | Bal. | Bal. | Bal. | Bal. | Bal. | Bal. | Bal. | Bal. | Bal. |

NOTE:
Composition of the 15 test alloys as determined by AiResearch--all utilized Master Heat V 2333 as starting material.

Four test plates approximately 4"×5" by 0.25" thick were cast from each foundry pour. In order to maintain a uniform degree of mechanical and thermal stress in the weld test specimens, the welding procedures, tooling and weld parameters were established on similated test plates and held as constant as possible throughout the investigation. The typical weld schedule utilized is shown in Table II. All weld specimens were subjected to the penetrant inspection P-133, Type I, METHOD A, Group V per MIL-I-6866, etched with Marbles reagent and visually examined under 40X magnification after welding and subsequent thermal treatments. Selected cross-sections were made for macro and microexamination of all welded chemistries during the investigation.

chemistry were also obtained in their various conditions indicated in the welding schedule shown in Table II.

TABLE II

WELD SPECIMEN SUMMARY

| Welding Schedule | Specimen Code No. | Filler Wire | Thermal* Treatment | Results and Comments |
|---|---|---|---|---|
| 1 | 713LC Control Standard | INCO 625 | 1 | Both plates exhibited the extensive fine heat-affected zone cracking--typical of the general 713LC welding problem. |
| 1 | 713LC from Monoform Wheel | INCO 625 | 1 | |
| 2 | A-1-1*1 | INCO 625 | 1 + 2 | Penetrant inspection of all 10 plates |
| 2 | A-1-2 | " | 1 + 3 | after welding disclosed no crack indi- |
| 2 | B-1-1*1 | " | 1 + 2 | cations. X-X-1 samples were ground to |
| 2 | B-1-2 | " | 1 + 3 | remove the weld bead reinforcement |
| 2 | C-1-1 | " | 1 + 2 | prior to thermal cycling--those marked |
| 2 | C-1-2 | " | 1 + 3 | *1 developed strain age type cracks |
| 2 | D-1-1*1 | " | 1 + 2 | after thermal treatment. X-X-2 samples |
| 2 | D-1-2 | " | 1 + 3 | were thermal cycled "as welded" . All |
| 2 | E-1-1 | " | 1 + 2 | samples except A-1-2 developed strain |
| 2 | E-1-2 | " | 1 + 3 | age type cracks. |
| 3 | A-2-1 | " | 1 + 4 | Penetrant inspection of all 10 plates |
| 3 | A-2-2 | " | 1 | after welding disclosed no crack indi- |
| 3 | B-2-1 | " | 1 + 4 | cations. X-X-1 samples developed |
| 3 | B-2-2 | " | 1 | strain age type cracks after thermal |
| 3 | C-2-1 | " | 1 + 4 | cycling. X-X-2 samples were not thermally |
| 3 | C-2-2 | " | 1 | treated. |
| 3 | D-2-1 | " | 1 + 4 | |
| 3 | D-2-2 | " | 1 | |
| 3 | E-2-1 | " | 1 + 4 | |
| 3 | E-2-2 | " | 1 | |
| **Welding Schedule** | **Specification Code No.** | **Filler Wire** | **Thermal* Treatment** | **Results and Comments** |
| 4 | A-3-1 | Pure nickel | 1 | Penetrant inspection of all 12 plates |
| 4 | A-3-2 | No filler | 1 + 5 | after welding disclosed no crack indica- |
| 4 | B-3-1 | Pure nickel | 1 | tions except the extensive HAZ cracking |
| 4 | B-3-2 | No filler | 1 + 5 | of both 713LC control standards. X-X-2 |
| 4 | C-3-1 | Pure nickel | 1 | samples and the corresponding control |
| 4 | C-3-2 | No filler | 1 + 5 | standard were thermally cycled. All |
| 4 | D-3-1 | Pure nickel | 1 | samples except the already extensively |
| 4 | D-3-2 | No filler | 1 + 5 | cracked control sample developed strain |
| 4 | E-3-1 | Pure nickel | 1 | age type cracks. The X-X-1 samples and |
| 4 | E-3-2 | No filler | 1 + 5 | control were not thermally cycled. |
| 4 | 713LC Control | No filler | 1 | |
| 4 | Standard | No filler | 1 + 5 | |
| 5 | A-1-3 | INCO 625 | 6 + 5 + 3 | Penetrant inspection of all 5 plates after |
| 5 | B-1-3 | " | 6 + 5 + 3 | welding disclosed no crack indications. |
| 5 | C-1-3 | " | 6 + 5 + 3 | Penetrant and visual inspection at 40X did |
| 5 | D-1-3 | " | 6 + 5 + 3 | not disclose any cracks after either |
| 5 | E-1-3 | " | 6 + 5 + 3 | thermal cycle 5 or 3. |
| 6 | A-1-4 | INCO 625 | 6 + 3 + 5 | Penetrant inspection and visual inspection |
| 6 | B-1-4 | " | 6 + 3 + 5 | at 40X revealed no crack indications after |
| 6 | C-1-4 | " | 6 + 3 + 5 | welding or thermal cycles 3 or 5. |
| 6 | D-1-4 | " | 6 + 3 + 5 | |
| 6 | E-1-4 | " | 6 + 3 + 5 | |
| 7 | A-2-3 | No filler | 6 + 3 + 5 | Penetrant inspection and visual inspection |
| 7 | B-2-3 | No filler | 6 + 3 + 5 | at 40X revealed no crack indications after |
| 7 | C-2-3 | No filler | 6 + 3 + 5 | welding or thermal cycles 3 or 5. |
| 7 | D-2-3 | No filler | 6 + 3 + 5 | |
| 7 | E-2-3 | No filler | 6 + 3 + 5 | |

*NOTE:
Thermal Treatments are as Follows:
(1) = Welded in the as-cast condition.
(2) = 1900° F./10 min. simulated braze/solution cycle.
(3) = 1950° F./10 min. simulated braze/solution cycle.
(4) = 1600° F./10 min. elevated temperature cycle.
(5) = 1325° F./8 hrs. + furnace cool to 1150° F./8 hrs. + air cool - age cycle INCO 718.
(6) = 1950° F./45 min. + furnace cool to 1850° F./2 hrs. + air cool - preweld conditioning cycle.

The initial specimens were TIG (tungsten inert gas) welded with Inconel 625 (nickel base alloy with 22% Cr, 9% Mo, 4% Cb, 0.2% Al, etc.) filler wire while selected referee check specimens were welded with pure nickel filler wire and without filler wire. Tensile specimens of each of the five alloys A–E were machined from the cast test plates and tested at room temperature in the as-cast and thermally treated conditions. Brinell hardness measurements of each base metal Examination of the standard 713LC alloy welded in the as-cast condition with the established welding parameters, as a base line reference, showed extensive cracking in the heat-affected zone. This cracking was observed to be typical hot tear cracking. Specimens of the modified alloys A–E, three carbon-aluminum content modifications each, were welded in the as-cast condition with the same established welding parameters, and showed no cracking of the weld or base metal.

These results would indicate that increasing the carbon content and lowering the aluminum content is effective in elimination of the low-melting eutectic gamma prime phase and providing a higher incipient melting point of the base metal alloy.

The welded test plates of the as-cast modified alloys A–E were subsequently thermal cycled to temperatures of 1950° F., 1600° F. and 1325° F. Examination of these specimens after each thermal cycle, disclosed evidence of strain age cracking in the weld zone for each of the modified alloys. In most cases the cracking progressed from the heat-affected zone into the base metal and across the weld through the entire thickness of the specimen.

During the welding of the modified alloy as-cast specimens, the weld stresses are adequately accommodated within the more ductile grains, thus preventing cracking of the less ductile grain boundaries. However, when the welded as-cast specimens are subsequently subjected to thermal cycles, e.g. brazing or heat treatment, strain age cracking frequently occurs. Previous investigation of the strain age cracking problem indicates a probable cause is the rapid precipitation, contraction and strengthening within the grains during post-weld thermal cycles which occurs at a faster rate than the weld stresses are being relieved. The result is a transmittal of stresses to the less ductile grain boundaries causing fracture at these high stress points. To alleviate this problem, a pre-weld thermal conditioning cycle was instituted to overage the material with a resultant precipitation that retained adequate ductility within the grains.

Weld specimens, of all five modified alloys (15 specimens in all) receiving the pre-weld thermal conditioning, were welded and subsequently subjected to simulated braze cycles at 1950° F., and to the standard Inconel 718 aging cycle of 1325° F./8 hours plus furnace cool to 1150° F./8 hours plus air cool. No evidence of cracking in any of the modified alloy specimens was detected after welding or post-weld thermal cycles. A summary of the test specimens welded, their heat treatments, and inspection results is shown in Table II.

Table III summarizes the result of room temperature tensile testing of the 15 alloys tested hereby. The heat treatments used in this investigation are indicated in the second column of Table III.

TABLE III

| ROOM TEMPERATURE TENSILE TESTS | | | | | |
|---|---|---|---|---|---|
| Bar No. | Thermal Treatment | UTS (ksi) | 0.2% YS (ksi) | Elong. (%) | Hardness Brinell |
| IN-713C per AMS 5391 | As-cast | 110 min. | 100 min. | 3.0 min. | — |
| | | 95 | 90 | 4.0 | — |
| A-1-1 | As-cast | 124.7 | 116.2 | 1.5 | 301 |
| B-1-1 | ↓ | 123.7 | 118.6 | 1.0 | 301 |
| C-1-1 | ↓ | 123.7 | 116.0 | 1.5 | 313 |
| D-1-1 | ↓ | 116.0 | 108.2 | 1.0 | 301 |
| E-1-1 | ↓ | 116.2 | 106.1 | 2.0 | 301 |
| INCO 713LC Cont. Std. | ↓ | 139.9 | 120.6 | 6.5 | — |
| A-2-1 | Table II Treatment | 132.3 | 122.4 | 2.5 | 301 |
| B-2-1 | No. 2 | 125.6 | 118.4 | 2.0 | 307 |
| C-2-1 | ↓ | 123.5 | 112.7 | 2.0 | 301 |
| D-2-1 | ↓ | 103.0 | 93.4 | 1.0 | 301 |
| E-2-1 | ↓ | 118.5 | 102.5 | 3.0 | 287 |
| A-3-1 | Table II Treatment | 121.0 | 100.0 | 3.5 | 289 |

TABLE III-continued

| ROOM TEMPERATURE TENSILE TESTS | | | | | |
|---|---|---|---|---|---|
| Bar No. | Thermal Treatment | UTS (ksi) | 0.2% YS (ksi) | Elong. (%) | Hardness Brinell |
| B-3-1 | No. 6 | 117.9 | 102.6 | 2.5 | 301 |
| C-3-1 | ↓ | 114.8 | 95.7 | 1.5 | 289 |
| D-3-1 | ↓ | 120.0 | 107.7 | 1.5 | 301 |
| E-3-1 | ↓ | 123.8 | 102.4 | 2.5 | 289 |
| INCO 713LC Cont. Std. | ↓ | 153.1 | 114.8 | 11.0 | 289 |
| A-1-3 | ↓ | 118.9 | 91.7 | 4.0 | — |
| A-2-3 | ↓ | 85.8 | 72.7 | 5.5 | — |
| A-3-3 | ↓ | 114.2 | 94.7 | 3.0 | — |
| B-1-3 | ↓ | 101.8 | 92.5 | 1.0 | — |
| B-2-3 | ↓ | 110.3 | 88.2 | 1.0 | — |
| B-3-3 | ↓ | 98.9 | 92.1 | 1.0 | — |
| C-1-3 | ↓ | 89.3 | 83.6 | 1.0 | — |
| C-2-3 | ↓ | 111.9 | 87.9 | 2.0 | — |
| C-3-3 | ↓ | 97.0 | 93.6 | 1.0 | — |
| D-1-3 | ↓ | 60.6 | BBY* | 0.5 | — |
| D-2-3 | ↓ | 112.9 | ND** | 5.0 | — |
| D-3-3 | ↓ | 113.4 | ND** | 3.0 | — |
| E-1-3 | Table II Treatment | 112.5 | ND** | 2.0 | |
| E-2-3 | No. 6 | 119.8 | ND** | 4.0 | |
| E-3-3 | ↓ | 92.1 | ND** | 0.5 | |
| A-1-7 | Table II Treatments | 129.4 | 126.4 | 5.5 | 313 |
| A-2-7 | Nos. 6, 3, & 5 | 114.7 | 86.7 | 1.0 | |
| A-3-7 | | 98.3 | 82.0 | 1.0 | |
| B-1-7 | ↓ | 108.8 | 95.3 | 1.0 | 313 |
| B-2-7 | ↓ | 100.5 | 87.4 | 1.0 | |
| B-3-7 | ↓ | 98.0 | 97.6 | 1.0 | |
| C-1-7 | ↓ | 90.2 | 86.7 | 1.0 | 313 |
| C-2-7 | ↓ | 95.8 | BBY* | 1.0 | |
| C-3-7 | ↓ | 82.7 | BBY* | 0.5 | |
| D-1-7 | ↓ | 114.2 | ND** | 0.5 | 313 |
| D-2-7 | ↓ | 73.7 | ND** | 1.0 | |
| D-3-7 | ↓ | 105.2 | ND** | 0.5 | |
| E-1-7 | ↓ | 117.9 | ND** | 2.0 | 313 |
| E-2-7 | ↓ | 85.1 | ND** | 0.5 | |
| E-3-7 | ↓ | 109.7 | ND** | 3.0 | |
| IN-713C per AMS 5391 | As-cast | 110 | 100.0 | 3.0 | |

BBY* - Broke before yielding.
ND** - Not determined.

It is observed that the as-cast properties of all five modified alloys meet the yield and ultimate strength requirements of the INCONEL 713C, specification AMS5391 (Aerospace Material Specified) which is utilized by the industry; though the elongation from such alloys was below the minimum requirement, probably resulting from the higher carbon content which induces larger amounts of the less ductile carbides.

Thus it can be seen from the above test and Tables I through III, that modification of the standard nickel base castable superalloys by controlled reduction of the maximum aluminum content and controlled increase of the minimum carbon content, will prevent base metal cracking in the heat affected zone during welding operations. It is further observed that the pre-weld thermal conditioning of the modified alloys prevents the occurrence of strain age cracking of weldments during subsequent thermal cycling. The room temperature tensile data of the alloys modified in accordance with our present invention, indicates that they retain mechanical comparable properties, except for elongation, to that of the standard Nickel base castable superalloy, Inconel 713C.

Separately cast test bars were then made from three master heats of modified Inconel 713C, the analysis of which is shown in Table IV.

TABLE IV

| CERTIFIED CHEMISTRY ANALYSIS - CANNON MUSKEGON MASTER HEATS | | | | | | | | | | | |
|---|---|---|---|---|---|---|---|---|---|---|---|
| | Carbon | Al | Ti | Cr | Mo | Cb + Ta | Zr | Fe | Si | B | Ni |
| Heat VE 599 | .18 | 5.3 | .72 | 13.1 | 4.73 | 2.22 | .06 | .52 | .09 | .007 | Bal |
| Heat VE 600 | .23 | 5.4 | .70 | 12.9 | 4.8 | 2.19 | .06 | .54 | .06 | .006 | Bal |
| Heat VE 601 | .12 | 5.4 | .71 | 12.9 | 4.81 | 2.24 | .06 | .52 | .24 | .009 | Bal |
| Inco 713C AMS 5391) | .08–.20 | 5.5–6.5 | .5–1.0 | 12–14 | 3.8–5.2 | 1.8–2.8 | .05–.15 | 2.5max | 0.5max | .005–.015 | Bal |
| Inco 713LC EMS 55079) | .05–.07 | 5.5–6.5 | .04–1.0 | 11–13 | 3.8–5.2 | 1.5–2.5 | .05–.15 | 0.25max | 0.5max | 0.005–0.015 | Bal |

The test bars were tested in the as-cast and pre-weld thermal cycle (1950° F. for ¾ hours, cooled to 1850° F. and held for 2 hours, then furnace cooled to ambient temperature) conditions for initial comparison with the minimum requirements of the Inconel 713C and Inconel 713LC specifications. The result of these initial tests are shown in Table V.

TABLE V

| | Yield, psi | Ultimate, psi | % Elongation |
|---|---|---|---|
| AS CAST, R.T. TENSILE PROPERTIES | | | |
| Heat VE 599 | 131,900 | 145,700 | 2.0 |
| " | 135,400 | 156,000 | 4.0 |
| " | 135,400 | 149,300 | 2.5 |
| Heat VE 600 | 132,470 | 150,300 | 4.0 |
| " | 133,000 | 150,300 | 5.0 |
| " | 132,200 | 153,700 | 5.5 |
| Heat VE 601 | 111,300 | 142,000 | 8.5 |
| " | 129,800 | 147,000 | 4.0 |
| " | 128,300 | 143,700 | 3.5 |
| PREWELD THERMAL TREATMENT, R.T. TENSILE PROPERTIES | | | |
| Heat VE 599 | 108,100 | 129,600 | 5.5 |
| " | 125,100 | 147,700 | 5.0 |
| " | 115,100 | 147,700 | 5.0 |
| Heat VE 600 | 126,700 | 146,300 | 3.0 |
| " | 124,700 | 141,500 | 3.0 |
| " | 127,500 | 146,700 | 3.0 |
| Heat VE 601 | 124,400 | 150,700 | 5.5 |
| " | 110,200 | 138,700 | 6.5 |
| " | 124,800 | 144,200 | 5.0 |
| Inco 713C (AMS 5391) | 100,000 | 110,000 | 3.0 |
| Inco 713LC (EMS 55079) | 100,000 | 110,000 | 5.0 |

| | Hours | % Elongation |
|---|---|---|
| AS CAST STRESS RUPTURE PROPERTIES 1800° F. AT 22KSI | | |
| Heat VE 599 | 25.0 | 11.0 |
| " | 33.0 | 10.5 |
| " | 25.0 | 10.5 |
| Heat VE 600 | 23.1 | 15 |
| " | 26.0 | 12 |
| " | 22.8 | 17 |
| Heat VE 601 | 33.0 | 13.0 |
| " | 29.8 | 12.5 |
| " | 27.8 | 13.0 |
| PREWELD THERMAL TREATMENT STRESS RUPTURE PROPERTIES 1800° F. AT 22KSI | | |
| Heat VE 599 | 22.0 | 12.0 |
| " | 29.6 | 10.0 |
| " | 47.5 | 21.0 |
| Heat VE 600 | 29.6 | 14.0 |
| " | 19.0 | 15.0 |
| " | 22.1 | 13.0 |
| Heat VE 601 | 21.5 | 15.0 |
| " | 30.0 | 22.0 |
| " | 31.1 | 17.5 |
| Inco 713LC (EMS 55079) | 23.0 | 3.0 |

As can be seen from these data, the modified Inconel 713C alloys have the capability of retaining the minimum specification requirements for tensile and stress rupture strength of the Inconel 713C specification, however, slightly lower room temperature tensile ductility will be realized.

The cast test plates obtained from master heats VE599 and VE600 which were given the pre-weld thermal conditioning, showed no base metal cracking during welding and post-weld thermal cycling. Cast test plates from heat VE601 (0.12% carbon) exhibited intermittent cracking while all Inconel 713LC (0.06% carbon) cast test plates experienced weld cracking.

Another heat of Incone! 713C type alloy modified in accordance with our present invention and identified as AiResist 319, was obtained in an amount sufficient to provide 9 cast rings, and the rings were cast with a rectangular cross section dimensioned to allow machining of an elongated interturbine duct configuration. The composition of the master heat from which these rings were cast, is shown in Table VI.

TABLE VI

| (AiResist 319) | |
|---|---|
| Carbon | 0.21% |
| Aluminum | 5.3% |
| Titanium | 0.67% |
| Chromium | 13.45% |
| Molybdenum | 4.15% |
| Columbium plus Tantilum | 2.34% |
| Zirconium | 0.09% |
| Iron | 0.07% |
| Silicon | 0.03% |
| Boron | 0.011% |
| Nickel | Balance |

Mechanical property test specimens were removed tangentially from one of the cast rings and prepared as 0.25" diameter gauge section test bars. Tensile specimens were tested at room temperature, 1200° F. and 1500° F. in the as-cast condition. Stress rupture specimens were tested at 1500° F. and 55 KSI in the as-cast condition. Specimens were also tensile tested at 1200° F. after exposure at 1500° F. for up to 2000 hours. These thermal exposure specimens were subjected to a pre-weld thermal conditioning of 1950° F. for ¾ hours followed by holding at 1850° F. for 2 hours and subsequent furnace cooling to ambient temperature.

The mechanical properties resulting from the specimens removed from the cast test rings and tested in the as-cast condition at room temperature, 1200° F. and 1500° F. are detailed in Tables VII, VIII and IX.

TABLE VII

Airesist-319
Room Temperature Tensile Properties
of As-Cast Specimens Machined
From The Cast Ring Configuration

| Test Bar No. | Location In Test Ring | Yield Strength (Ksi) | Ultimate Strength (Ksi) | Elong. % |
|---|---|---|---|---|
| 1 | Removed from | 101.3 | 110.2 | 5.5 |
| 2 | the center | 101.0 | 111.0 | 5.0 |

TABLE VII-continued

Airesist-319
Room Temperature Tensile Properties
of As-Cast Specimens Machined
From The Cast Ring Configuration

| Test Bar No. | Location In Test Ring | Yield Strength (Ksi) | Ultimate Strength (Ksi) | Elong. % |
|---|---|---|---|---|
| 3 | of the cast | 101.5 | 110.0 | 5.0 |
| 4 | test ring | 104.1 | 111.2 | 5.5 |
| 5 | | 97.4 | 101.8 | 4.0 |
| 6 | | 101.5 | 109.5 | 4.5 |
| 7 | | 103.6 | 111.0 | 3.5 |
| 8 | | 101.5 | 109.2 | 4.5 |
| 9 | Removed from | 101.0 | 112.0 | 4.5 |
| 10 | the edges of | 105.7 | 113.0 | 4.5 |
| 11 | the cast | 106.3 | 118.0 | 4.8 |
| 12 | test ring | 99.8 | 113.0 | 6.0 |
| 13 | | 105.9 | 116.4 | 4.4 |
| 14 | | 99.4 | 106.5 | 3.2 |
| 15 | | 102.0 | 106.3 | 4.4 |
| 16 | | 98.2 | 105.4 | 3.6 |
| 17 | | 103.9 | 111.8 | 4.1 |
| 18 | | 100.8 | 112.4 | 4.3 |
| 19 | | 103.1 | 114.5 | 5.0 |
| 20 | | 103.9 | 113.0 | 6.6 |
| 21 | | 101.4 | 112.8 | 4.4 |
| 22 | | 101.0 | 112.0 | 3.2 |
| 23 | | 101.5 | 109.3 | 3.8 |
| 24 | | 99.0 | 108.9 | 4.6 |
| Average of the tests of material removed from the center of the test ring | | 101.5 | 109.2 | 4.1 |
| Average of the tests of material removed from the edges of the test ring | | 102.1 | 118.6 | 4.7 |
| Overall average of all tests | | 101.9 | 115.5 | 4.5 |

TABLE VIII

Airesist-319
1200° F. Tensile Properties of
As-Cast Specimens Machined
From the Cast Ring Configuration.
All Test Specimens Were Removed
Around The Edges of the Ring Casting.

| Test Bar No. | Yield Strength (Ksi) | Ultimate Strength (Ksi) | Elongation % | RA % |
|---|---|---|---|---|
| 1 | 97.3 | 115.5 | 4.9 | 9.3 |
| 2 | 98.8 | 113.5 | 4.9 | 9.3 |
| 3 | 92.5 | 107.8 | 4.4 | 11.1 |
| 4 | 92.6 | 113.1 | 4.9 | 8.7 |
| 5 | 96.9 | 110.1 | 4.1 | 5.5 |
| 6 | 95.8 | 111.9 | 3.7 | 6.8 |
| 7 | 97.2 | 111.7 | 3.7 | 4.7 |
| 8 | 95.0 | 111.0 | 3.7 | 9.1 |
| 9 | 97.2 | 113.1 | 4.3 | 6.4 |
| 10 | 93.0 | 107.2 | 3.4 | 7.8 |
| 11 | 94.9 | 107.6 | 3.5 | 6.0 |
| 12 | 97.9 | 108.5 | 3.2 | 4.9 |
| 13 | 95.3 | 109.1 | 3.7 | 5.0 |
| 14 | 95.7 | 106.6 | 2.9 | 4.9 |
| 15 | 92.2 | 103.0 | 3.8 | 11.3 |
| Average of the 15 tests | 95.5 | 110.0 | 3.94 | 7.39 |

TABLE IX

Airesist-319
1500° F. Tensile Properties of
As-Cast Specimens Machined
From The Cast Ring Configuration.
All Test Specimens Were Removed
Around The Edges Of The Ring Casting.

| Test Bar No. | Yield Strength (Ksi) | Ultimate Strength (Ksi) | Elongation % | RA % |
|---|---|---|---|---|
| 16 | 93.0 | 115.9 | 3.9 | 4.4 |
| 17 | 89.0 | 111.9 | 4.0 | 6.1 |
| 18 | 90.9 | 111.8 | 3.7 | 5.4 |
| 19 | 89.5 | 112.0 | 4.9 | 6.1 |
| 20 | 92.8 | 115.0 | 4.9 | 5.3 |
| 21 | 91.5 | 114.5 | 3.7 | 3.9 |
| 22 | 93.9 | 117.7 | 3.5 | 6.3 |
| 23 | 91.3 | 116.7 | 2.8 | 3.1 |
| 24 | 99.9 | 116.1 | 3.2 | 3.7 |
| 25 | 91.3 | 116.9 | 2.9 | 5.3 |
| 26 | 91.7 | 118.2 | 3.3 | 3.9 |
| 27 | 92.2 | 114.3 | 4.2 | 5.5 |
| 28 | 87.9 | 116.6 | 3.4 | 4.7 |
| 29 | 93.4 | 116.4 | 3.9 | 4.2 |
| 30 | 93.9 | 113.9 | 3.9 | 6.1 |
| Average of the 15 tests | 92.2 | 115.2 | 3.77 | 8.11 |

The average yield and ultimate strength at all test temperatures exceeded the average Incone 713LC values published in the standard industry design reference MIL-handbook 5, with the exception of tensile ductility which was reduced from approximately 8% for the Inconel 713LC to slightly below 4% for the alloy (AiResist 319) modified in accordance with our invention.

The 1500° F. and 55 KSI stress rupture results of as-cast specimens from the cast test rings are detailed in Table X. The average stress rupture life of these specimens compared identically with the average stress rupture strength of Inconel 713LC shown in the published literature and specifications.

TABLE X

AiResist-319
Stress-Rupture Properties
of As-Cast Specimens Machined From The
Cast Ring Configuration Tested at 1500° F. and 55 KSI

| Test Bar No. | Rupture Time (hrs) | Elongation % | R.A. % | Larson-Mille Parameter |
|---|---|---|---|---|
| 31 | 146.1 | 5.8 | 5.9 | 43.44 |
| 32 | 153.5 | 5.5 | 5.9 | 43.48 |
| 33 | 171.9 | 5.8 | 7.2 | 43.58 |
| 34 | 182.1 | 6.3 | 6.6 | 43.63 |
| 35 | 139.8 | 5.9 | 6.7 | 43.41 |
| 36 | 140.8 | 5.3 | 6.4 | 43.41 |
| 37 | 150.2 | 5.3 | 5.7 | 43.47 |
| 38 | 157.4 | 5.0 | 6.0 | 43.51 |
| 39 | 174.4 | 5.5 | 5.9 | 43.59 |
| 40 | 161.1 | 5.9 | 6.8 | 43.53 |
| 41 | 138.0 | 5.5 | 5.8 | 43.39 |
| 42 | 153.6 | 5.0 | 5.3 | 43.49 |
| 43 | 184.3 | 6.0 | 7.9 | 43.64 |
| 44 | 184.8 | 6.8 | 7.5 | 43.64 |
| 45 | 160.8 | 6.8 | 8.0 | 43.52 |

Tensile results of specimens removed from the cast test ring and subjected to 500, 1000 and 2000 hour exposure at 1500° F. prior to testing at 1200° F. are detailed in Table XI. These specimens were given the standard pre-weld thermal treatment prior to the 1500° F. static air exposure. The comparative 1200° F. tensile strength of the specimen receiving up to 2000 hours exposure and similarly pre-weld heat treated specimens receiving no exposure, were approximately the same. The results of the exposure tests indicated that no metallurgical instability occurred and no significant change in the tensile strength or ductility in the alloy modified in accordance with our present invention, will occur as a result of long time exposure at 1500° F. Comparison of the as-cast and pre-weld heat treated 1200° F. mechanical properties of our modified alloy, indicates that tensile ductility will be reduced approximately 1% by the pre-weld heat treatment.

TABLE XI

AiResist-319
1200° F. Tensile Properties of
Pre-Weld Heat Treated Specimens
Machined From the Cast Ring Configuration
and Exposed in Static Air at 1500° F. for
500, 1000 and 200 Hours. All Test
Specimens Were Removed Around the Edges of the Ring Casting

| Test Bar No. | Exposure Time at 1500° F. (Hours) | Yield Strength (ksi) | Ultimate Strength (ksi) | Elongation % | R.A. % |
|---|---|---|---|---|---|
| 1 | No Exposure | 94.5 | 101.8 | 2.3 | 5.9 |
| 2 | No Exposure | 100.2 | 113.3 | 2.7 | 6.7 |
| 3 | No Exposure | 96.1 | 108.2 | 2.5 | 5.1 |
| 4 | No Exposure | 97.6 | 110.4 | 2.6 | 5.1 |
| 5 | 500 | 97.4 | 113.4 | 3.5 | 8.6 |
| 6 | 500 | 96.5 | 115.1 | 3.3 | 6.3 |
| 7 | 500 | 97.8 | 111.0 | 3.3 | 4.0 |
| 8 | 500 | 94.1 | 103.0 | 2.6 | 4.7 |
| 9 | 1000 | 99.4 | 111.5 | 2.5 | 6.7 |
| 10 | 1000 | 97.4 | 113.2 | 4.0 | 9.0 |
| 11 | 1000 | 96.1 | 114.1 | 3.3 | 4.7 |
| 12 | 1000 | 96.9 | 113.4 | 3.1 | 5.5 |
| 13 | 2000 | 102.6 | 112.8 | 3.5 | 7.0 |
| 14 | 2000 | 99.8 | 100.4 | 2.0 | 2.0 |
| 15 | 2000 | 97.3 | 113.1 | 3.5 | 6.7 |
| 16 | 2000 | 99.4 | 105.9 | 2.5 | 4.0 |

Following the cast ring evaluations, a development lot of interturbine duct castings from the alloy shown in Table VI were cast, evaluated and determined to be acceptable, and were subsequently fabricated into interturbine ducts. The improved weldability exhibited by these parts allowed TIG welding directly to the turbine duct castings with good success, thereby eliminating the previous practice of electron beam welding transition rings made of the prior art Inconel 713LC alloy to the casting. The use of the transition rings was necessitated by the inability to TIG weld directly to Inconel 713LC, combined with dimensional considerations. After welding, the completed assemblies were inspected and one detail was selected for endurance testing in a TFE731 engine. The interturbine duct completed 192 hours and 146 starts in such engine following the standard FAA endurance test cycle.

Subsequent fabrication of the three modified alloy interturbine duct assemblies, proceeded with no evidence of weld cracking. The successful elimination of the three transition rings as previously required with Iconel 713LC, was shown to result in a substantial per part manufacturing cost savings.

The duct assembly selected for engine evaluation was inspected before and after the engine test. Evaluation following engine testing showed no evidence of weld associated cracking or any other sign of distress.

From the above, it has been concluded that the modification of the Inconel 713LC composition in accordance with our present invention, by controlled reduction of the aluminum content and increasing the carbon content, was effective in developing an alloy which displays excellent heat affected zone cracking resistance during fusion welding operations. Additionally, preweld thermal conditioning of the modified alloy has been established as a necessary processing step in the prevention of strain age cracking of weldments during post welding thermal cycling, such as brazing or heat treatment operations. The results of the foregoing mechanical property and thermal stability evaluations, indicate that despite the lower ductility, engine testing has verified the acceptability of the alloy modified in accordance with our present invention, for applications such as the TFE731 interturbine duct assembly.

While our invention has been described herein with reference to certain specific embodiments, it is to be understood that the scope of our invention should not be limited to such embodiments, but rather should be afforded the full scope of the appended claims.

We claim as our invention:

1. A welded article of cast Nickel base super alloy for use at elevated temperatures up to about 1800 degrees F., characterized by resistance to weld cracking, room temperature ultimate strength of at least 100,000 psi, 0.2% offset yield strength of at least 95,000 psi with at least 3% elongation, and a minimum stress rupture time of 23 hours at a constant stress of 65,000 psi at 1500 degrees F., consisting essentially of an alloy of about 12 to 14% Chromium, about 3.8 to 5.2% Molybdenum, 4.5 to 5.5% Aluminum, 0.16 to (0.25%) 0.26% Carbon, 0.5 to 1.0% Titanium, 1.8 to 2.8% Columbium plus Tantalum, 0.05 to 0.10% Zirconium, and the balance substantially all Nickel.

2. The welded article (alloy) of claim 1 containing about (0.16 to 0.20%) 0.20 to 0.26% Carbon, 5.0 to 5.5% Aluminium, 0.5 to 1.0% Titanium, 12 to 14% Chromium, 3.8 to 5.2% Molybdenum, 1.8 to 2.8% Columbium plus Tantalum, 0.05 to 0.10% Zirconium and the balance substantially all Nickel.

3. A cast structural article for use at elevated temperatures up to about 1800° F. which is resistant to weld cracking and strain age cracking during thermal cycling subsequent to welding, cast from a Nickel base alloy which is strengthened by solid solution strengthening, gamma prime phase precipitate strengthening and carbide strengthening, and having its Carbon content increased to the range of about 0.16 to 0.25% and its Aluminum content reduced to the range of about 4.5 to 5.5%, said article having been subjected to preweld thermal conditioning, comprising the steps of:

(a) heating said article to a temperature of about 1950° F. for at least about 45 minutes, (b) cooling said article to about 1850° F. and holding at said temperature for at least about 2 hours, and (c) cooling said article to ambient temperature at a rate comparable to air cooling.

4. The article of claim 3 wherein said Carbon content is increased to the range of about 0.16 to 0.20% and said Aluminum content is reduced to the range of about 5.0 to 5.5%.

5. A cast structural article for use at elevated temperatures up to about 1800° F. which is resistant to weld cracking and strain age cracking during thermal cycling subsequent to welding, cast from a Nickel base alloy which is strengthened by solid solution strengthening, gamma prime phase precipitate strengthening and carbide strengthening, and having its Carbon content increased to the range of about 0.16 to 0.25% and its Aluminum content reduced to the range of about 4.5 to 5.5% and having a room temperature ultimate strength of at least 100,000 psi, and an 0.2% offset yield strength of at least 95,000 psi with at least 3% elongation, with a minimum stress rupture time of 23 hours at a constant stress of 65,000 psi at 1500° F., said article having been subjected to pre-weld thermal conditioning, comprising the steps of:

(a) heating said article to a temperature of about 1950° F. for at least about 45 minutes, (b) cooling said article to about 1850° F. and holding at said temperature for at least about 2 hours, and (c) cooling said article to ambient temperature at a rate comparable to air cooling.

6. A cast structural article for use at elevated temperatures up to about 1800° F. which is resistant to weld cracking, made from an alloy consisting essentially of about 12 to 14% Chromium, about 3.8 to 5.2% Molybdenum, 4.5 to 5.5% Aluminum, 0.16 to 0.25% Carbon, 0.5 to 1.0% Titaniu, 1.8 to 2.8% Columbium plus Tantalum, 0.05 to 0.10% Zirconium, and the balance substantially all Nickel, said article having been subjected to pre-weld thermal conditioning comprising the steps of:

(a) heating to a temperature of about 1950° F. for at least about 45 minutes, (b) cooling said article to about 1850° F. and holding at said temperature for at least about 2 hours, and (c) cooling said article to ambient temperature at a rate comparable to air cooling.

7. A cast structural article for use at elevated temperatures up to about 1800° F. which is resistant to weld cracking, made from an alloy consisting essentially of about 12 to 14% Chromium, about 3.8 to 5.2% Molybdenum, 4.5 to 5.5% Aluminum, 0.16 to 0.25% Carbon, 0.5 to 1.0% Titanium, 1.8 to 2.8% Columbium plus Tantalum, 0.05 to 0.10% Zirconium, and the balance substantially all Nickel, and having a room temperature ultimate strength of at least 100,000 psi, and an 0.2% offset yield strength of at least 95,000 psi with at least 3% elongation, with a minimum stress rupture time of 23 hours at a constant stress of 65,000 psi at 1500° F., said article having been subjected to pre-weld thermal conditioning, comprising the steps of:

(a) heating said article to a temperature of about 1950° F. for at least about 45 minutes, (b) cooling said article to about 1850° F. and holding at said temperature for at least about 2 hours, and (c) cooling to ambient temperature at a rate comparable to air cooling.

8. The article of claim 7 wherein said alloy consists essentially of about 0.16 to 0.20% Carbon, 5.0 to 5.5% Aluminum, 0.5 to 1.0% Titanium, 12 to 14% Chromium, 3.8 to 5.2% Molybdenum, 1.8 to 2.8% Columbium plus Tantalum, 0.05 to 0.10% Zirconium and the balance substantially all Nickel.

9. A method for making a cast Nickel base alloy article for high temperature service, which article is resistant to hot cracking during welding and strain age cracking during subsequent thermal cycling, comprising the steps:

(a) modifying the chemistry of a Nickel base alloy which is strengthened by solid solution strengthening, gamma prime phase precipitate strengthening and carbide strengthening, by decreasing the Aluminum content to the range of about 4.5 to 5.5% and increasing the Carbon content to the range of about 0.16 to 0.26%, (b) heating said article to about 1950° F. and holding said article in said temperature range for at least about 45 minutes, (c) cooling said article to about 1850° F. and holding said article at said temperature for at least about 2 hours, and (d) cooling said article to ambient temperature at rate comparable to air cooling.

10. The method of claim 9 wherein said Nickel base alloy has the following composition: 12 to 14% Chromium, about 3.8 to 5.2% Molybdenum, about 4.5 to 5.5% Aluminum, about 0.16 to 0.26 % Carbon, about 0.5 to 1.0% Titanium, about 1.8 to 2.8% Columbium plus Tantalum, about 0.05 to 0.10% Zirconium, and the balance substantially all Nickel.

11. The method of claim 10 wherein said Nickel base alloy has the following composition: 12 to 14% Chromium, about 3.8 to 5.2% Molybdenum, about 5.0 to 5.5 Aluminum, about 0.16 to 0.20% Carbon, about 0.5 to 1.0% Titanium, about 1.8 to 2.8% Columbium plus Tantalum, about 0.05 to 0.10% Zirconium, and the balance substantially all Nickel.

* * * * *

UNITED STATES PATENT AND TRADEMARK OFFICE

CERTIFICATE OF CORRECTION

PATENT NO. : 4,336,312

DATED : June 22, 1982

INVENTOR(S) : Jeffrey J. Clark, Harry R. Fisk, Larry A. Wallace

It is certified that error appears in the above-identified patent and that said Letters Patent are hereby corrected as shown below:

Column 14, line 27, delete "(0.25%)"; line 31, delete "(alloy)"; line 32, delete "(0.16 to 0.20%)".

Column 15, line 18, change "Titaniu" to --Titanium--.

Signed and Sealed this

*Fifth* Day of *October 1982*

[SEAL]

*Attest:*

GERALD J. MOSSINGHOFF

*Attesting Officer*

*Commissioner of Patents and Trademarks*